US007857045B2

(12) United States Patent
Farrar et al.

(10) Patent No.: US 7,857,045 B2
(45) Date of Patent: Dec. 28, 2010

(54) TORQUE TRANSFER ARRANGEMENT AND METHOD

(75) Inventors: Amy L. Farrar, Houston, TX (US); Dennis G. Jiral, Katy, TX (US); Mark Kendall Adam, Houston, TX (US); Jeffrey Charles Williams, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 217 days.

(21) Appl. No.: 12/042,883

(22) Filed: Mar. 5, 2008

(65) Prior Publication Data

US 2009/0223362 A1 Sep. 10, 2009

(51) Int. Cl.
*E21B 23/00* (2006.01)

(52) U.S. Cl. ..... 166/125; 166/212; 166/381

(58) Field of Classification Search ..... 166/125, 166/212, 237, 242.6, 381, 382, 383
See application file for complete search history.

(56) References Cited

U.S. PATENT DOCUMENTS 3,283,824 A * 11/1966 Hoffman et al. ..... 166/212

OTHER PUBLICATIONS

Torquemaster. Retrieved from the Internet Jun. 5, 2008; http://www.nov.com; 3 pages.

* cited by examiner

*Primary Examiner*—David J Bagnell
*Assistant Examiner*—James G Sayre
(74) *Attorney, Agent, or Firm*—Cantor Colburn LLP

(57) ABSTRACT

A torque transfer arrangement includes a relatively immobile construct; a relatively mobile construct. The relatively mobile construct is radially adjacent the relatively immobile construct. One or more torque body assemblies are mounted to the relatively mobile construct. The assemblies are radially responsive to applied hydraulic pressure to contact a surface of a separate structure and transmit torque from the arrangement to the separate structure. A method is included.

15 Claims, 6 Drawing Sheets

TORQUE TRANSFER ARRANGEMENT AND METHOD

BACKGROUND

In the hydrocarbon recovery industry, many different tubular well tools and components are run in the hole over the life of the well. These components are required to be connected to a work string and then generally released in the downhole environment and the workstring removed from the well. While there are several methods for accomplishing this result, there are infinitely more possible situations encountered in the downhole environment that need to be overcome than methods and apparatus to address them.

SUMMARY

A torque transfer arrangement includes a relatively immobile construct; a relatively mobile construct radially adjacent the relatively immobile construct; and one or more torque body assemblies mounted to the relatively mobile construct and radially responsive to applied hydraulic pressure to contact a surface of a separate structure and transmit torque from the arrangement to the separate structure.

A torque body assembly includes a torque body; and a torque button movably attached to the body.

A torque transfer arrangement includes a first mandrel and a second mandrel interconnected by a mandrel piston; a torque button carrier having one or more torque body assemblies mounted therein disposed about the first mandrel; a hydraulically sealed annular space defined between the first mandrel and the carrier, the one or more assemblies in operable communication with the space; and a sleeve fixedly attached to the carrier and in hydraulically sealed contact with the mandrel piston, the sleeve further being fixedly attached to a deactivate piston, the sleeve, mandrel piston, second mandrel and deactivate piston defining a hydraulically sealed chamber.

BRIEF DESCRIPTION OF THE DRAWINGS

Referring now to the drawings wherein like elements are numbered alike in the several Figures.

DETAILED DESCRIPTION

Figure 1:
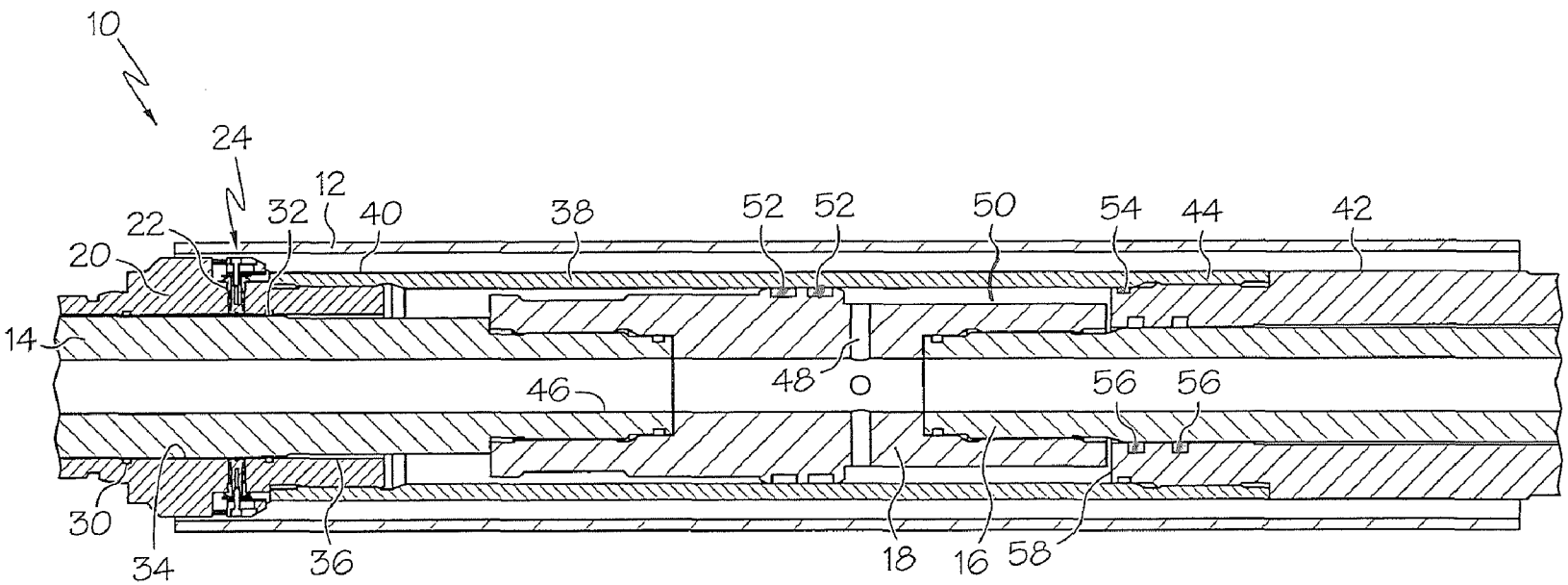
FIG. 1 is a schematic cross-sectional view of a torque transfer arrangement in an unactuated position.
Figure 2:
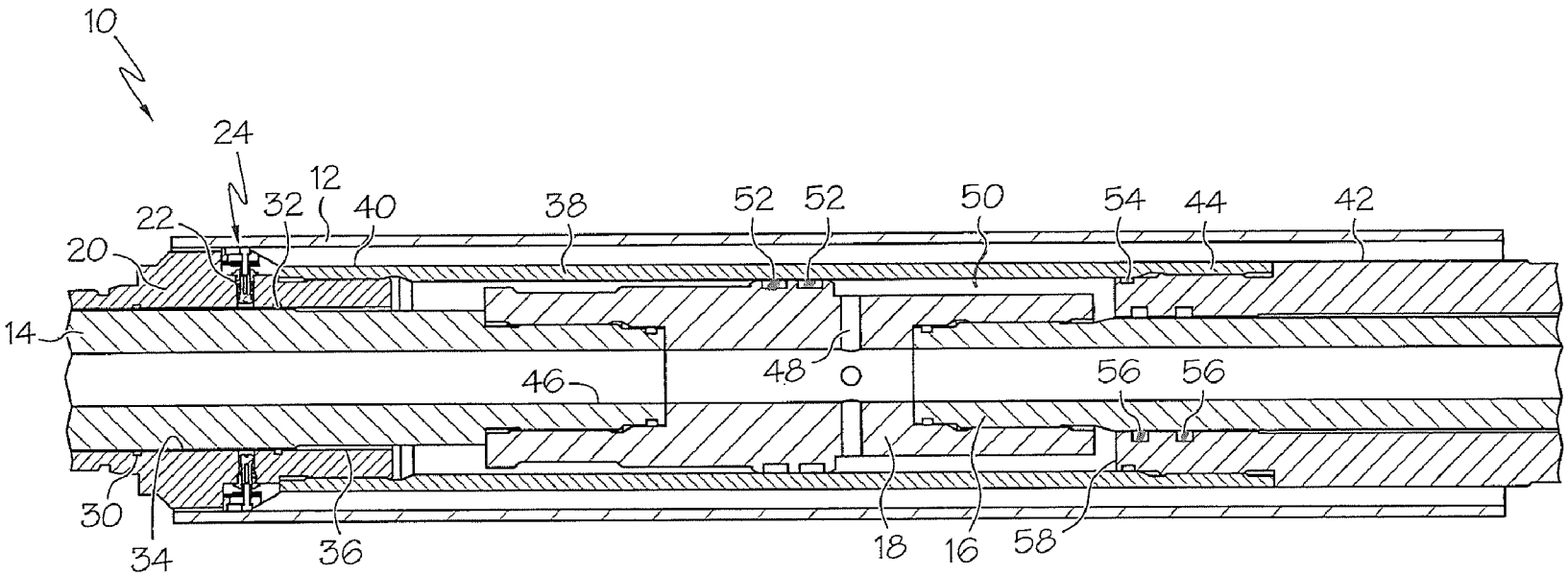
FIG. 2 is a schematic cross-sectional view of the FIG. 1 embodiment in an actuated position but in the sequence to deactivate.
Figure 3:
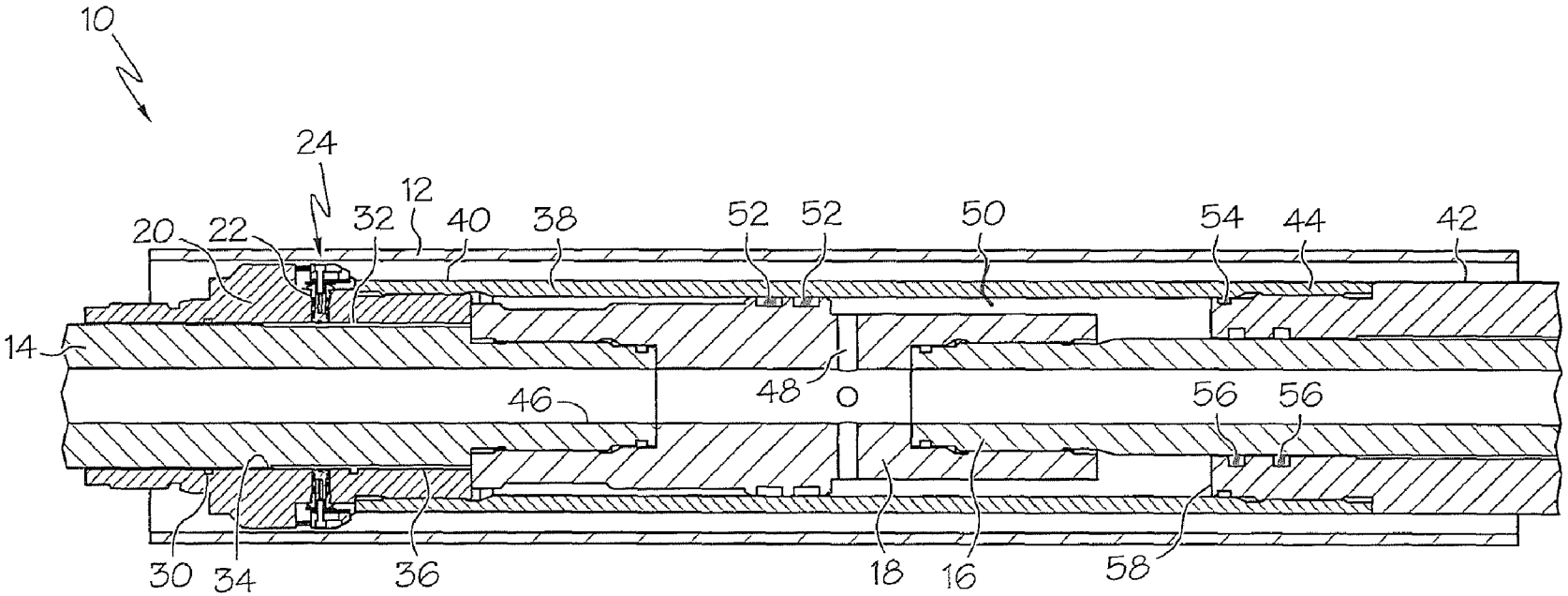
FIG. 3 is a schematic cross sectional view of the embodiment of FIG. 1 in a fully deactivated position.

Referring to FIGS. 1-3 simultaneously, three sequential positions of the torque transfer arrangement 10 are illustrated. In FIG. 1, the arrangement 10 is in a position where it has been introduced to a tubular member 12, which may be a casing or other tubular member and before actuation of the arrangement 10 to engage the tubular member 12 in a way that is effective in transferring torque from the arrangement 10 to the tubular member 12. FIG. 2 illustrates the arrangement 10 in a position wherein it is engaged with the casing 12 but is also in a position where that engagement is about to be removed. FIG. 3 illustrates the arrangement 10 in a fully deactivated position.

Referring to FIG. 1, the arrangement 10 includes a first mandrel 14 and a second mandrel 16. It is to be understood that the terms first and second are not intended to indicate order but rather are used only to distinguish different structural features of the arrangement 10. The two mandrels are interconnected physically and fluid conveyingly by a mandrel piston 18. Components 14, 16 and 18 (a relatively immobile construct) in this embodiment are relatively fixedly connected to a remote location through a running string (not shown) such as the surface of the well while other components to be introduced hereunder are movable thereon.

Disposed about the first mandrel 14 is a torque button carrier 20. Torque button carrier 20 houses one or more torque button bodies 22 which each make up a part of a torque body button assembly 24. The assemblies 24, in one embodiment, are equidistantly spaced about a periphery of the carrier 20 since distribution as such will tend to center the arrangement 10 in the tubular member and thereby equally distribute stresses therearound. It is noted, however, that it is also possible to arrange the assemblies in an eccentric arrangement if desirable for a particular situation. In the illustrated embodiment, the cross-section shows only two of the torque button body assemblies 24 but one of ordinary skill in the art will appreciate the possible spacing of other bodies in the event that the arrangement 10 constructed includes more than two assemblies 24. The number of assemblies employed is limited only by the practicality of available space and is thus somewhat dictated by the diameter of the arrangement 10. It is noted that with increasing number of assemblies 24, a greater total piston surface area is available to create radially directed force and so the torque holding ability of the arrangement 10 increases proportionally with the number of assemblies 24.

In addition to the assemblies 24, the torque button carrier 20 also houses a check valve 28 (see FIG. 4) that is not visible in FIGS. 1-3 because it is located, for this embodiment, out of the plane of the cross-section taken. The placement is for manufacturing and durability reasons and may be changed at will by a manufacturer without change of function of the arrangement 10.

The carrier 20 is movably disposed about the first mandrel 14 and fluid sealingly engaged therewith through seals 30 and 32, which in some embodiments are O-rings. Between the seals 30 and 32 is created an annular space 34 (see also FIGS. 4 and 5) through which hydraulic fluid is supplied to the one or more assemblies 24. Hydraulic fluid is supplied to the annular space 34 through the check valve 28. While the arrangement 10 is in the position illustrated in FIG. 1, pressure supplied through check valve 28 is directed through the annular space 34 to the assemblies 24. The reaction of the assemblies to the hydraulic fluid pressure will be addressed hereunder. It should be pointed out now, however, that the positions in which the arrangement 10 is illustrated in FIGS. 2 and 3, are both incapable of holding the hydraulic fluid pressure in the annular space 34 as seal 32 will leak that pressure into recess 36 in mandrel 14.

The carrier 20 is connected to a sleeve 38 that is fixedly attached to the carrier 20 at interconnection 40, which may be a threaded connection. The sleeve 38 is also fixedly interengaged with a deactivate piston 42 at interengagement 44, which may be a threaded connection. The carrier 20, sleeve 38 and deactivate piston 42 (a relatively mobile construct) thus move as a unit when an appropriate stimulus is present. In order to move the carrier, sleeve and piston, pressure is applied at the inside dimension 46 of the arrangement 10. The pressure in one embodiment is applied from a surface location. Such pressure in the inside dimension of the arrangement 10 is channeled through one or more (three visible) channels 48 to a chamber 50. The chamber 50 is fluidically sealed at each end thereof by seals 52, 54 and 56. Pressure in the chamber 50 thus acts on the only volumetrically changeable surface, piston face 58, of the chamber 50. Upon the application of sufficient pressure in chamber 50, the piston 42 will move in a direction away from the mandrel piston 18, pulling sleeve 38 and consequently carrier 20 with it. In this way the arrangement 10 can be disengaged from the tubular member 12 and thereafter retrieved or otherwise as desired. Further details of this process are provided hereunder.

Figure 4:
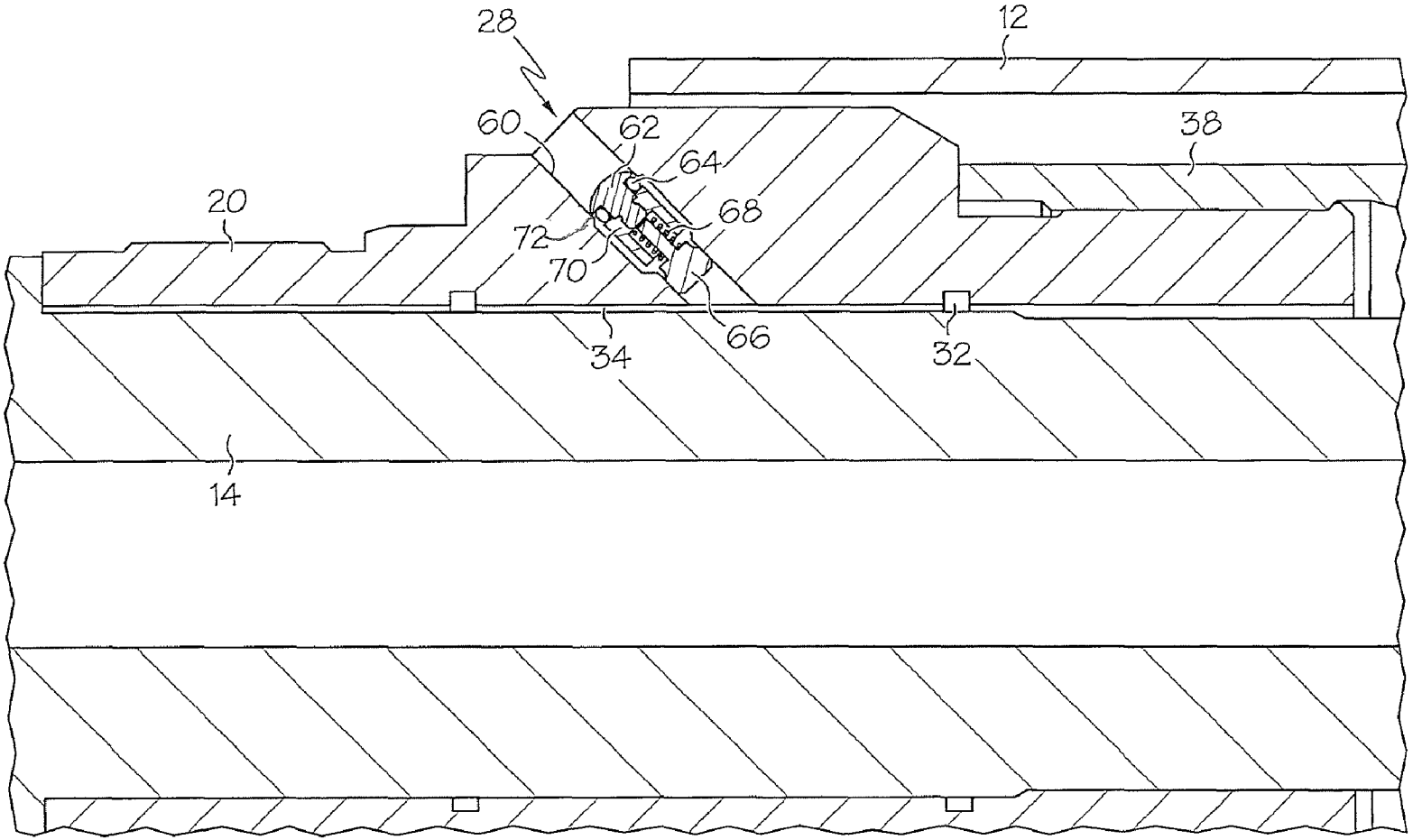
FIG. 4 is an enlarged schematic cross-section view of a pressurization check valve of the arrangement.
Figure 5:
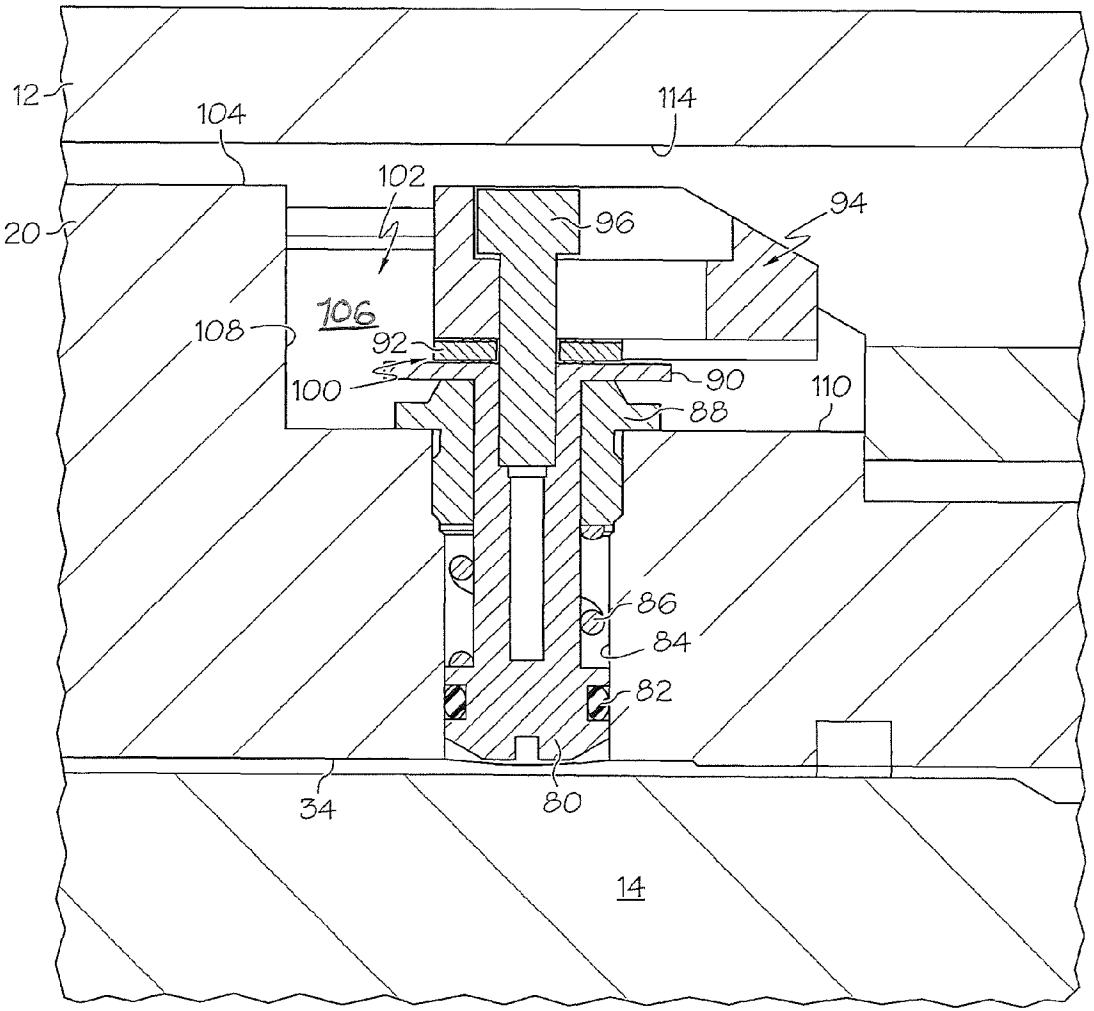
FIG. 5 is an enlarged schematic cross-section view of a torque body and torque button in situ.
Figure 6:
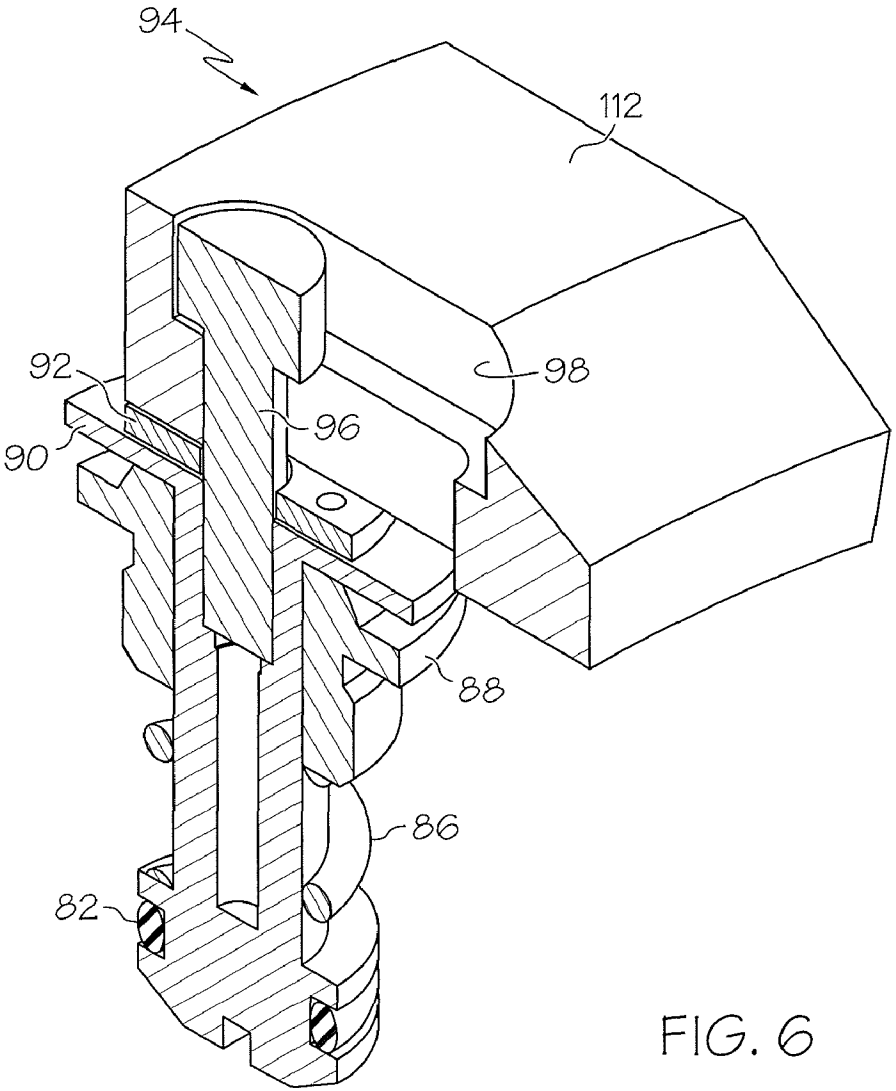
FIG. 6 is a perspective view of the torque body and torque button of FIG. 5 removed from the arrangement.

Referring now to FIGS. 4, 5 and 6 a more detailed explanation of the check valve 28, torque body assemblies 24 and their functions are provided. The check valve 28 is disposed in a fluid conduit 60 that is connectable to a fluid pressure source (not shown) such as a hydraulic control line that may extend from a surface location. The check valve is configured to allow hydraulic fluid to flow therepast in a direction toward the annular space 34. The valve itself includes a check valve cap 62 with a check valve o-ring 64 sealingly disposed about the cap 62. The cap 62 is fixedly connected to a check valve stem 66 around which is disposed a check valve spring 68. A spring retainer 70 is disposed about the spring to hold it in place. Once fluid is urged past the check valve 28 by unseating the o-ring 64 from an o-ring seat 72 with which it is sealingly engaged during times when the valve 28 is at rest, the fluid pressurizes the annular space 34. Once a desired pressure inside annular space 34 is achieved, the valve 28 will close due to a lack of excess pressure applied to the valve from the remote location. At that point, pressure in the control line (not shown) can be reduced or eliminated, as the pressure created in the space 34 cannot escape back through the valve 28. This is because the greater pressure in the annular space 34 urges the valve into a position where the o-ring 64 is repositioned back into sealing engagement with the o-ring seat 72 thereby preventing fluid movement out of the annular space 34.

The pressure in annular space 34 directly acts on the assembl(ies) 24, urging them to move radially. In the illustrated embodiment, the radial movement is outwardly but it is to be appreciated that the parts hereof could be reversed to cause the actuation to move the assemblies radially inwardly if desired. Focusing on FIGS. 5 and 6, one of the assemblies 24 is illustrated in an enlarged view. Each of the assemblies 24 includes a torque body 22 that comprises a body stem 80 having a seal 82 such as an o-ring therearound to seal against a bore 84 in the torque body carrier 20. This seal, and others of the one or more assemblies 24, provides a pressure tight moveable portion exposed to the pressure of the annular space 34. Upon rising pressure in the space then, the assemblies 24 will move radially outwardly (illustrated embodiment).

Additional components of the assemblies 24 include a return spring 86 disposed about the body stem 80 and bounded by a body cap 88. The body cap 88 is fixedly positioned within the bore 84 by any affixing means such as threads, press fit, adhesive, welding, brazing, etc. as the force borne thereby is only that generated by the spring 86. The body stem 80 includes a flange 90 that is used as a bearing surface for bearing or bushing 92. Riding upon bearing 92 is a torque button 94. The torque button 94 is attached to the body stem 80 with fastener 96, which may be a threaded fastener or other similar affixing means. Referring to FIG. 6, the button 94 includes an elongated opening 98 for fastener 96 to slide in during operation of the device as described in greater detail hereunder. Such sliding is assisted by the bearing 92, which as noted could also be a type of bushing and ultimately need only reduce a coefficient of friction at an interface 100 between the button 94 and the body stem 80. Each torque button 94 is rotationally fixed within the carrier 20 while being radially and axially movable therein by being disposed in a respective opening 102 such as a slot in an outer surface 104 of the carrier 20. Visible in FIG. 5 are a lateral wall 106, an axial wall 108 and a radially inwardly positioned wall 110 of the slot 102. The dimensions of the slot are such that the button 94 (one embodiment of which is shown in FIG. 6) is allowed to move radially and axially in at least one axial direction based upon the movements of the arrangement 10 disclosed herein.

Still referring to FIG. 5, when pressure in the annular space 34 is sufficiently raised to overcome the spring force of spring 86, the assembly 24 will react by moving radially outwardly until a surface 112 of the button 94 contacts an inside dimension surface 114 of the tubular member 12. The degree of force to be generated upon the surface 114 depends upon desired torque holding capacity and the conditions (such as temperature and pressure) at the location of the intended use of the torque holding capacity. The capacity is adjusted by the pressure supplied to the annular space 34 with higher pressures yielding higher torque carrying capacity. Care should be taken not to over pressurize the annular space 34 to prevent the tubular member 12 itself failing.

Referring back to FIGS. 1-3, operation of the arrangement 10 is described in greater detail. As noted, FIG. 1 illustrates the arrangement within the tubular member 12 but in an unactuated condition. In other words, the annular space has not yet been provided with a pressurization. Upon pressurization of the annular space 34, the assemblies 24 react as above stated and bring the buttons 94 into contact with the inside surface 114 of the tubular member 12. The force will be as selected using the pressure source. Once the desired pressure is supplied to the annular space 34 and the buttons have consequently generated the desired contact force against the tubular member 12, the arrangement 10 and the member 12 are run into the hole. When the position of the tubular member 12 is as selected by an operator and it is desired to release the tubular member, pressure is applied to an inside of the running string (not shown) which is fluidly connected to the inside dimension 46 of the arrangement 10. This pressure as noted above will migrate to chamber 50 ultimately causing carrier 20 to move relative to the mandrel 14. In order to prevent damage to the inside surface 114 of the tubular 12, the buttons 94 will not move with the carrier 20 but rather will stay in place while the carrier 20 moves. This is illustrated in FIG. 2. The reader should view the position of the torque body 22 relative to the button 94 in FIG. 1 and then FIG. 2 to appreciate the movement described. When the carrier 20 reaches the position illustrated in FIG. 2, it is to be appreciated that seal 32 is very close to an edge of recess 36 and so will bleed pressure from annular space 34. As pressure is bled from the space 34, the spring(s) 86 of the various one or more torque bodies 22 will begin to provide more force than that of the hydraulic fluid acting thereagainst. At this point, the buttons will disengage the surface 114 and the stroke of the carrier 20 can continue until complete disassociation of the button(s) 94 with the surface 114 is achieved. The arrangement is then ready to be retrieved from the hole and is as it appears in FIG. 3.

It is to be understood that although the above description with regard to release of the tubular member is directed to hydraulic pressure buildup within an ID of the string, it is also possible to mechanically shift the arrangement 10 by such as a pick up and slack off sequence.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A torque transfer arrangement comprising:

a relatively immobile construct;

a relatively mobile construct radially adjacent the relatively immobile construct;

one or more torque body assemblies mounted to the relatively mobile construct and radially responsive to applied hydraulic pressure to contact a surface of a separate structure and transmit torque from the arrangement to the separate structure an annular space defined by the relatively immobile construct and the relatively mobile construct, the space in communication with the one or more torque body assemblies, the space being hydraulically sealed and wherein the arrangement is configured to allow hydraulic pressure escape from the annular space upon relative movement between the relatively immobile construct and the relatively mobile construct.

2. The arrangement as claimed in claim 1 wherein the relatively immobile construct includes a recess into which hydraulic pressure escapes upon the relative movement.

3. The arrangement as claimed in claim 1 wherein the one or more torque body assemblies each include a torque body and a torque button movably attached thereto.

4. The arrangement as claimed in claim 3 wherein the torque button includes an elongated opening receptive of a fastener interconnecting the button and the torque body.

5. The arrangement as claimed in claim 4 wherein the elongated opening facilitates movement of the torque body relative to the button.

6. The arrangement as claimed in claim 1 wherein the relatively mobile construct is movable relative to the relatively immobile construct responsive to a fluid pressure applied through an inside dimension of the relatively immobile construct, the pressure acting on the relatively mobile construct through a channel in the relatively immobile construct.

7. The arrangement as claimed in claim 1 wherein the relatively mobile construct further includes one or more openings receptive of a torque button of each of the torque body assemblies to restrict rotational movement of the one or more buttons relative to a tubular structure to which torque is being applied while allowing radial and axial movement of the one or more buttons relative to the relatively mobile construct.

8. A torque transfer arrangement comprising:

a relatively immobile construct:

a relatively mobile construct radially adjacent the relatively immobile construct: and one or more torque body assemblies mounted to the relatively mobile construct and radially responsive to applied hydraulic pressure to contact a surface of a separate structure and transmit torque from the arrangement to the separate structure;

an annular space defined by the relatively immobile construct and the relatively mobile construct, the space in communication with the one or more torque body assemblies, the space being hydraulically sealed, the space being in fluid communication with a check valve arranged to allow fluid pressure to enter the space and prevent fluid pressure froth exiting the space through the check valve.

9. A method for transferring torque to a tubular structure comprising:

disposing an arrangement as claimed in claim 1 into a separate tubular structure;

pressuring an annular space defined by the relatively immobile construct and the relatively mobile construct; and urging the one or more torque body assemblies to move radially with the pressure axially shifting the relatively mobile construct relative to the relatively immobile construct and releasing hydraulic pressure to a recess in the relatively immobile construct to release the one or more torque assemblies from the tubular structure.

10. The method as claimed in claim 9 wherein the method further comprises contacting a surface of the tubular structure with the one or more assemblies with sufficient radial force to transmit torque from the arrangement to the tubular structure.

11. A torque transfer arrangement comprising:

a first mandrel and a second mandrel interconnected by a mandrel piston;

a torque button carrier having one or more torque body assemblies mounted therein disposed about the first mandrel;

a hydraulically sealed annular space defined between the first mandrel and the carrier, the one or more assemblies in operable communication with the space; and a sleeve fixedly attached to the carrier and in hydraulically sealed contact with the mandrel piston, the sleeve further being fixedly attached to a deactivate piston, the sleeve, mandrel piston, second mandrel and deactivate piston defining a hydraulically sealed chamber.

12. The torque transfer arrangement as claimed in claim 11 wherein pressure increase within the chamber causes the deactivate piston, the sleeve and the carrier to move relative to the first mandrel, second mandrel and mandrel piston.

13. The torque transfer arrangement as claimed in claim 12 wherein the movement unseals the annular space.

14. The torque transfer arrangement as claimed in claim 11 wherein the one or more torque body assemblies are equidistantly spaced about a perimeter of the carrier.

15. The torque transfer arrangement as claimed in claim 11 wherein the one or more body assemblies each include a torque button moveably attached to a torque body.

* * * * *